United States Patent [19]

Rachels, Sr.

[11] 4,416,251

[45] Nov. 22, 1983

[54] THERMOSHIELD

[75] Inventor: William H. Rachels, Sr., Memphis, Tenn.

[73] Assignee: Rachels-Horton Industries, Inc., Memphis, Tenn.

[21] Appl. No.: 317,125

[22] Filed: Oct. 30, 1981

[51] Int. Cl.[3] ..... F24C 15/36

[52] U.S. Cl. ..... 126/201; 126/279; 237/79

[58] Field of Search ..... 126/201, 202, 279, 278, 126/277, 121; 237/52, 79; 165/53, 55, 56; 52/280–282

[56] References Cited

U.S. PATENT DOCUMENTS

| | | | |
|---|---|---|---|
| 469,875 | 3/1892 | Sweeney | 126/278 |
| 1,970,054 | 8/1934 | Nordan | 126/201 |
| 4,217,094 | 8/1980 | Crowley | 126/202 |
| 4,295,460 | 10/1981 | Wilson | 126/202 |

FOREIGN PATENT DOCUMENTS

| | | | |
|---|---|---|---|
| 1357410 | 2/1964 | France | 126/279 |
| 2031577 | 4/1980 | United Kingdom | 126/279 |

*Primary Examiner*—James C. Yeung

*Attorney, Agent, or Firm*—Walker & McKenzie

[57] ABSTRACT

A thermoshield primarily intended to be used for protecting a wall from the heat that may develop by a free-standing heating appliance or space heater that may be situated in proximity to the wall. However, certain structure of the device may be adapted to be used for restingly supporting thereon the heating appliance, thus protecting a floor from the heat developed thereby. The thermoshield features a sub-assembly of particular construction which serves as a heat barrier in either of the above mentioned dispositions, and peculiar support structure for supporting the sub-assembly in place between the heating appliance and the wall to be protected. A significant feature of the support structure is that the sub-assembly remains absolutely unaltered by the implementation of the support structure.

5 Claims, 14 Drawing Figures

THERMOSHIELD

BACKGROUND OF THE INVENTION

1. Field of the Invention

This invention relates to the field of heat barriers or shields for the wall behind free standing heating appliances as well as the floor upon which such heating appliances may restingly be supported.

2. Description of the Prior Art

It is well-known that energy has been in an abundant supply in this country for the past several decades. Accordingly, during this time, conservation of energy, at least in most modern day residential structures, has been of little or no interest. However, the recent spiraling cost of fuel and the recognized necessities for conserving energy are bringing about changes in the manner in which many homes are heated today. Among these changes is the reintroduction of the old fashioned potbellied stove concept. Of course, many modern modifications to the old type stove have been made, but the presence of the free standing heating appliance or space heater, usually using wood, coal or other materials as a source of fuel, is becoming more and more common throughout the country.

It is well-known that these type heating appliances develop a tremendous amount of heat usually necessitating that the wall adjacent thereto be protected in some form or other and that the floor also be protected from this heat. Therefore, there exists a need for a thremoshield which is, of course, noncombustible. Moreover, the thermoshield should contain no asbestos.

The concept of providing a thermoshield for this purpose was first disclosed many years ago. In fact, applicant is aware of the following U.S. Pat. Nos. pertaining to various shields of this nature: 485,363 granted to Adrianson in 1892; and 1,764,595 granted to Anderson in 1930. Other patents pertaining to similar structure of this nature, as known by the applicant, consist of: U.S. Pat. No. 801,690 granted to Ralls in 1905; U.S. Pat. No. 874,296 granted to Brown in 1907; U.S. Pat. No. 1,970,504 granted to Nordan in 1934; U.S. Pat. No. 2,482,376 granted to Serkland in 1949; U.S. Pat. No. 2,629,370 granted to Janski in 1953; and U.S. Pat. No. 4,148,302 granted to Patterson in 1979. It is significant to note that none of the above mentioned patents suggests or discloses applicant's device.

SUMMARY OF THE INVENTION

The present invention is directed toward overcoming the disadvantages and problems that may exist in previous thermoshields and the like. The specific purpose for the device of the present invention is to provide a thermoshield which may primarily be used for protecting a wall from the heat that may be developed by a free-standing heating appliance or space heater that may be situated in proximity to the wall. However, certain structure of the device, as herein disclosed, may be adapted for use in restingly supporting thereon the heating appliance. In this fashion the floor is protected from the heat developed by the space heater. The thremoshield of the present invention features a sub-assembly of particular construction which serves as a heat barrier in either of the above mentioned dispositions, and peculiar support structure for supporting the sub-assembly in place between the heating appliance and the wall to be protected, i.e., when used as a wall shield.

A significant feature of the support structure herein disclosed is that the sub-assembly of the present invention remains absolutely unaltered by the implementation of the inventive support structure.

The specific structure depended upon in disclosing the concept of the present invention will be expounded upon later in the specification. Accordingly, for a better understanding of this invention, at least one embodiment thereof will be fully described by making explicit reference to the accompanying drawings, in which the various parts will progressively be disclosed or indicated by numerals arranged in an ascending order.

DESCRIPTION OF THE PREFERRED EMBODIMENT

Figure 1:
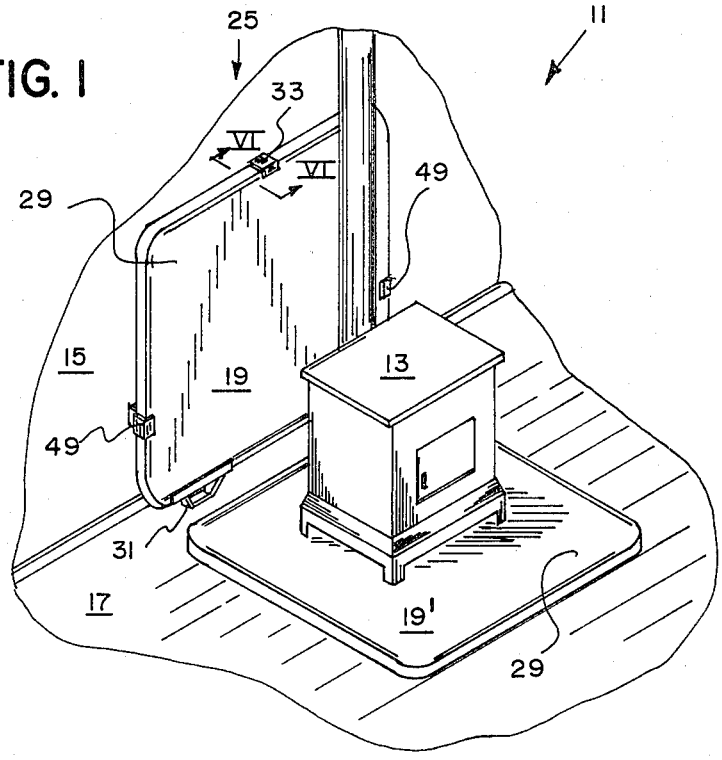
FIG. 1 is a perspective view of a free-standing heating appliance with the thermoshield of the present invention shown attached to the wall behind the heating appliance and with a portion thereof (sub-assembly) shown restingly supporting the heating appliance thereon.

The thermoshield means 11 of the present invention is intended for use in conjunction with a space heating appliance such as that shown in FIG. 1 and characterized therein by the numeral 13. Moreover, the thermoshield means 11 is primarily intended to be used for protecting a wall, as at 15, from the heat that may develop by the heating appliance 13, i.e., when situated in proximity to the wall 15 in the manner shown. However, it will be interesting to note that certain structure of the thermoshield means 11 may by adapted, in a manner to be shown, so as to be used for restingly supporting thereon the heating appliance 13, thus protecting a floor, as at 17, from the heat developed thereby.

The thermoshield means 11 includes a sub-assembly, as at 19, which includes a planar sheet of heat insulating material as at 21, e.g., mineral board which preferably does not contain asbestos, for providing an optimum heat barrier. The sub-assembly 19 also includes a panel member, as at 23, formed from durable sheet metal or the like for providing support and a covering for at least one side of the sheet of heat insulating material 21 and thusly establishing a durable obverse for the sub-assembly 19. From FIG. 3 of the drawings it may be seen that the marginal edges of the panel member 23 are foldably doubled about the entire perimeter of the sheet of heat insulating material 21 thus encasing the obverse side and the marginal edges thereof. Moreover, the panel member 23 is fixedly crimped in place about the perimeter of the reverse side of the sub-assembly 19. The crimp will be characterized in the drawings by the numeral 24 which, of course, is a well-known procedure. Therefore, it may readily be seen that the panel member 23 provides a durable protective covering for the heat insulating material 21. In other words the insulating material constitutes a core for the sub-assembly 19. Therefore, the heat insulating material 21 may hereinafter optionally be referred to as simply the core 21.

Figure 2:
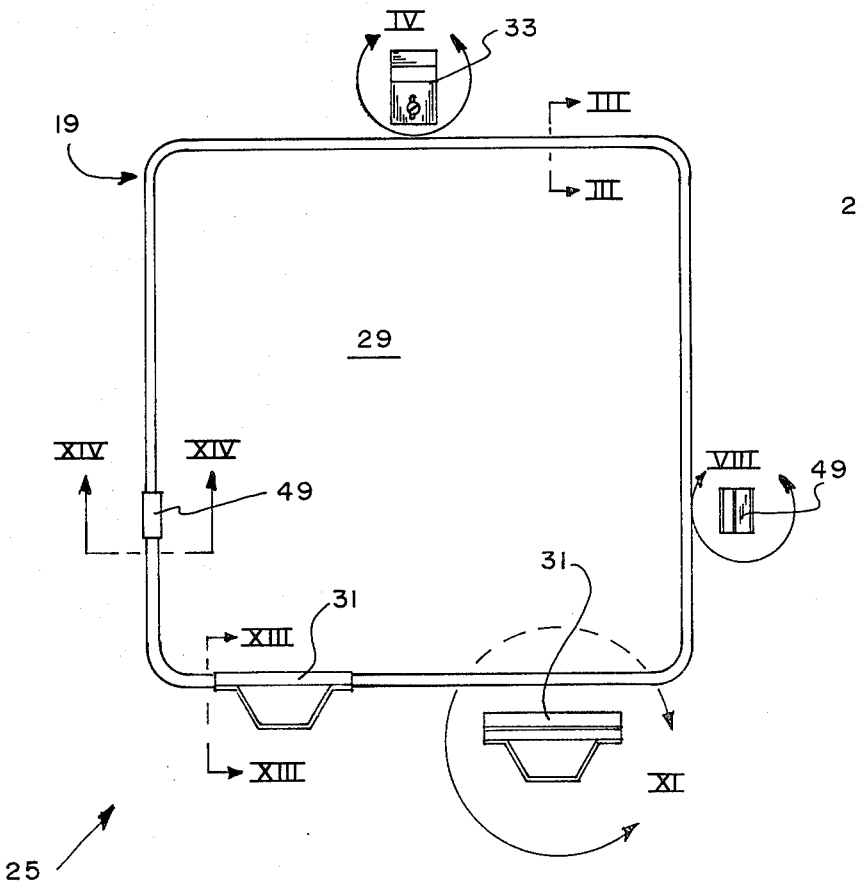
FIG. 2 is a somewhat exploded view of the detached thermoshield (prior to being installed on the wall) as clearly shown in FIG. 1.

From FIGS. 1 and 2 et al of the drawings it may readily be seen that the thermoshield means 11 preferably includes support means generally indicated at 25 for supporting the sub-assembly 19 in an optimum upright disposition between the space heating appliance 13 and the wall 15 situated adjacent thereto. Thus, the sub-assembly 19 provides a heat shield or barrier for the wall 15.

Figure 3:
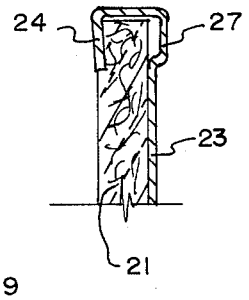
FIG. 3 is an enlarged partial sectional view taken as on the line III—III of FIG. 2.

From FIGS. 2 and 3 et al of the drawings it may readily be seen that the thermoshield means 11 preferably includes continuous ridge means, as at 27, which defines the circumjacency of the obverse side 29 of the sub-assembly 19 for providing an enhancement in the effectiveness of the support means 25. The significance of the ridge means 27 will become apparent as the specification proceeds.

From FIGS. 1 and 2 et al of the drawings it may also be seen that the support means 25 includes at least: (1) leg support means, as at 31, for engaging and thus supporting the lowermost portion of the sub-assembly 19 a spaced distance above the floor surface 17, thus allowing for free passage of air beneath the thermoshield 11; and (2) solitary upper-offset bracket/wall attachment means, as at 33, for: (a) establishing and maintaining an optimum spaced distance between the uppermost portion of the sub-assembly 19 and the wall 15 which is being shielded therewith, and (b) providing a solitary means for attaching the sub-assembly 19 to the wall 15. In other words, an important feature of the present invention is the ultra simplicity of installing the device 11 to the wall 15, i.e., this feature will become apparent as the specification proceeds.

Figure 6:
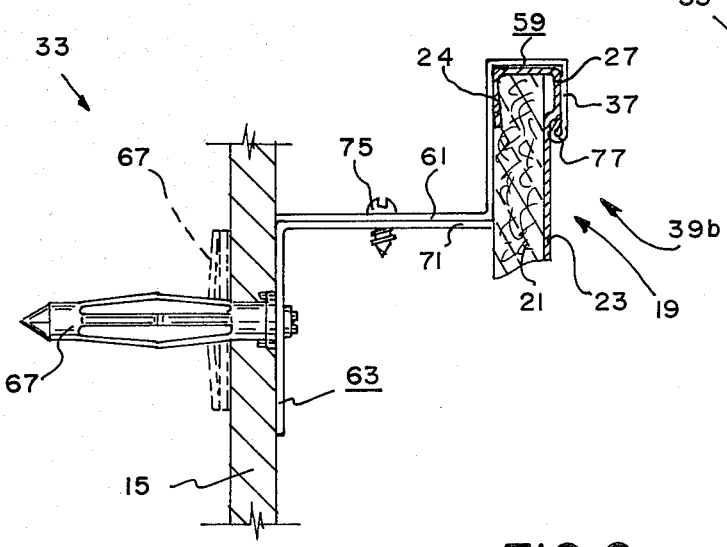
FIG. 6 is an enlarged partial sectional view taken as on the line VI—VI of FIG. 1.
Figure 4:
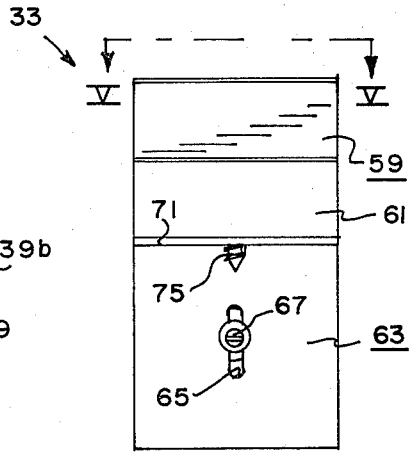
FIG. 4 is an enlarged view of the structure circumscribed as at IV in FIG. 2 of the drawings.
Figure 10:
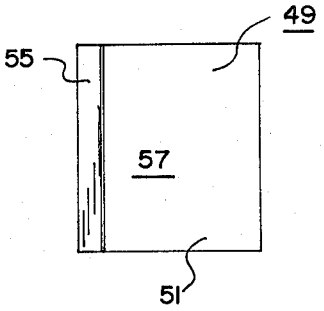
FIG. 10 is a top plan view of the structure shown in FIG. 9 with the view being taken along the line X—X of FIG. 9.
Figure 13:
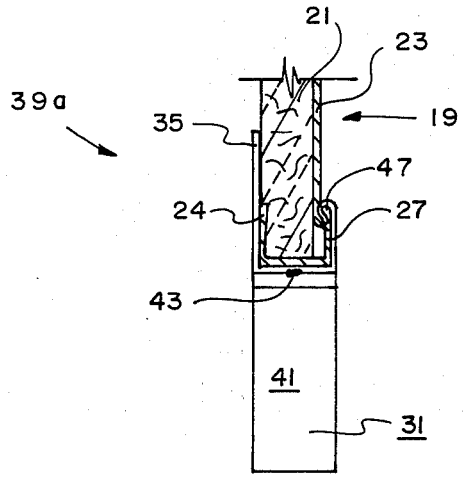
FIG. 13 is an enlarged partial sectional view taken as on the line XIII—XIII of FIG. 2.

Particular attention will now be directed toward FIG. 13 of the drawings wherein it may be seen that the leg support means 31 includes leg attachable/detachable means, as at 35, for removably joining the leg support means 31 to the sub-assembly 19. In addition, particular attention will be directed toward FIG. 6 of the drawings wherein it may be seen that the solitary upper-offset bracket/wall attachment means 33 includes solitary bracket attachable/detachable means, as at 37, for removably joining the solitary upper-offset bracket/-wall attachment means 33 to the sub-assembly 19.

It will be significant to note that the leg attachable/-detachable means 35 (FIGS. 12, 13) as well as the solitary attachable/detachable means 37 (FIGS. 6, 7) are similarly characterized by peculiar-shaped self-engageable channellike means, as at 39, for interlockable engagement with the ridge means 27. Therefore, it may be stated that the support means 25 includes a plurality of the peculiar-shaped self-engageable channellike means 39 which may hereinafter be individually designated as **39*a*, 39*b*, 39*c*, etc., which are individually adapted for interlockable engagement with the ridge means 27 in a manner to be fully disclosed. In other words, the leg attachable/detachable means 35 (FIGS. 12, 13) is characterized by the peculiar-shaped self-engageable channellike means 39*a* while the solitary brackets attachable/detachable means 37 (FIGS. 6,7) is characterized by the peculiar-shaped self-engageable means 39*b***, and so forth for still other structure yet to be disclosed.

Figure 11:
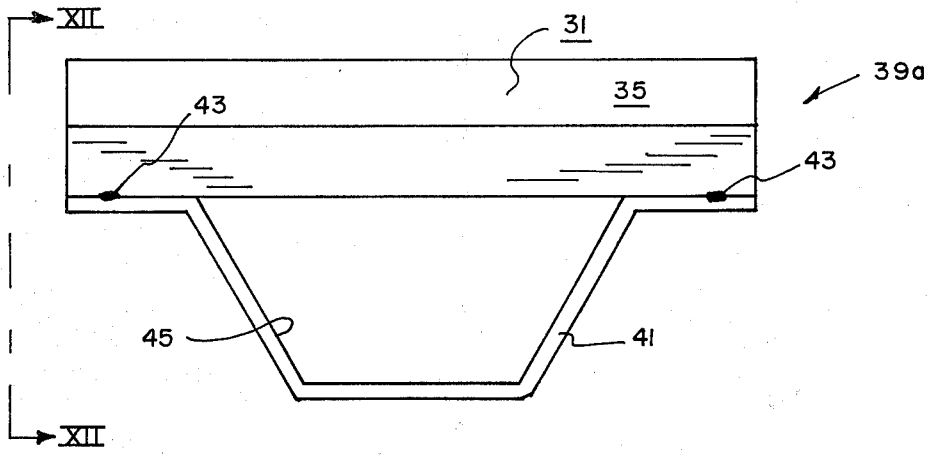
FIG. 11 is an enlarged view of the support structure circumscribed as at XI in FIG. 2.
Figure 12:
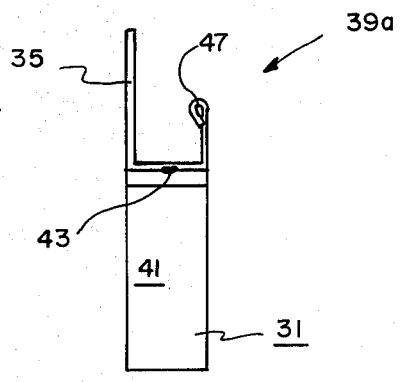
FIG. 12 is an end view of the structure depicted in FIG. 11 with the view being taken along the line XII—XII of FIG. 11.

Particular attention will now be directed toward FIGS. 11 through 13 of the drawings wherein it may be seen that the leg support means 31 not only includes the previously mentioned peculiar-shaped self-engageable channellike means **39*a*, but a foot member 41 is fixedly attached thereto in any well-known manner as by spot welding or the like characterized by the numeral 43. The foot member 41 preferably is provided with an enlarged opening as at 45 to enhance the flow of air therethrough, i.e., it is desirable that the leg support means 31 not impede the flow of air since the wall 15** should continuously be bathed with a flow of air thus achieving optimum temperature control.

The peculiar-shaped self-engageable channellike means **39*a* (FIGS. 12, 13) includes an elongated protuberant member, as at 47, which is intended to interlock with the ridge means 27 in a manner as best shown in FIG. 13 of the drawings. Accordingly, in this manner, it may be seen that the elongated protuberant member 47 and the peculiar-shaped self-engageable channellike means 39*a* are significant features of the support means 25 in that the sub-assembly 19 remains absolutely unaltered by the implementation of the support means 25 or more specifically the leg support means 31**.

Figure 9:
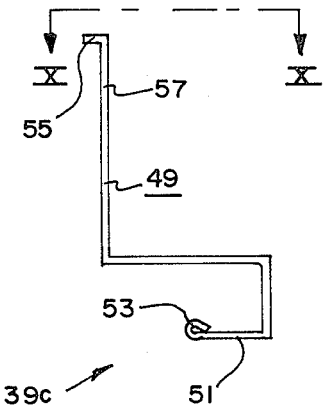
FIG. 9 is a top plan view of the structure shown in FIG. 8 with the view being taken along the line IX—IX of FIG. 8.
Figure 8:
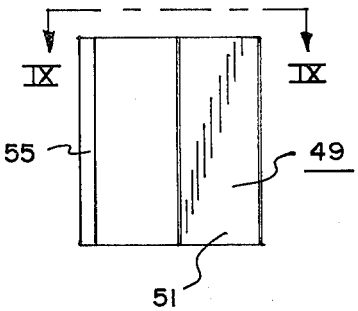
FIG. 8 is an enlarged view of the support structure circumscribed as at VIII in FIG. 2.

Particular attention will now be directed toward FIGS. 2 and 8 through 10 of the drawings wherein it may be seen that the support means 25 also includes a pair of lower-offset bracket means, as at 49, for establishing and maintaining an optimum spaced distance between the lowermost portion of the sub-assembly 19 and the wall 15 which is being shielded therewith. Moreover, each of the lower-offset bracket means includes spacer attachable/detachable means, as at 51, for removably joining the lower-offset means 49 to the sub-assembly 19. Here again, the spacer attachable/-detachable means 51 is further characterized by having a portion or one of the plurality of peculiar-shaped self-engageable channellike means attached thereto, i.e., the peculiar-shaped self-engageable channellike means **39*c* as best shown in FIG. 9 of the drawings is attached to the lower-offset bracket means 49**.

Figure 14:
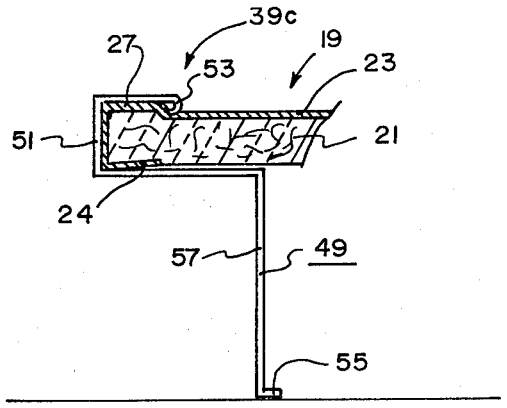
FIG. 14 is an enlarged partial sectional view taken as on the line XIV—XIV of FIG. 2.

The lower-offset bracket means 49 also includes an elongated protuberant member, as at 53, which is substantially identical with the above mentioned protuberant member 47 and functions in like manner. In other words, the protuberant member 53 interlockably engages the ridge means 27 in such a manner that the sub-assembly 19 remains absolutely unaltered by the implementation of the lower-offset bracket means 49 in a manner clearly depicted in FIG. 14 of the drawings.

From FIGS. 8 through 10 and 14 of the drawings it may be seen that the lower-offset bracket means 49 includes a wall engaging member, as at 55, which is intended to restingly engage the wall 15 and a stand-off member, as at 57, interposed between the wall engaging member 55 and the peculiar-shaped self-engageable channellike means 39*c* for providing the optimum spaced distance between the lowermost portion of the sub-assembly 19 and the wall 15. In this manner, the offset arrangement of the bracket means 49 provides for optimum air flow behind the sub-assembly 19.

Figure 7:
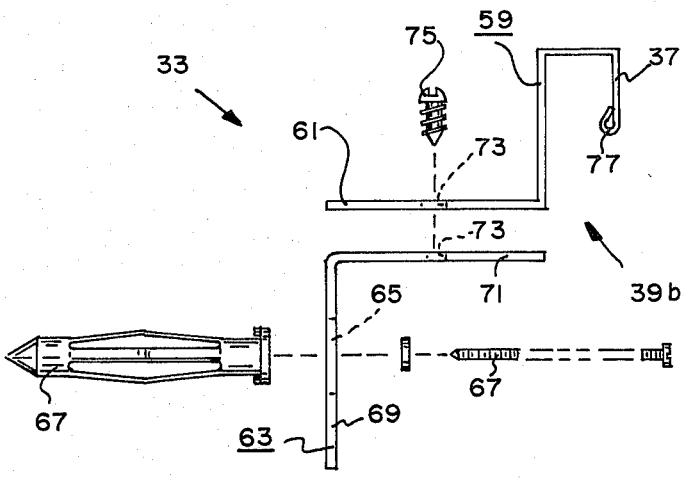
FIG. 7 is an exploded view of merely the support structure shown in FIG. 6.
Figure 5:
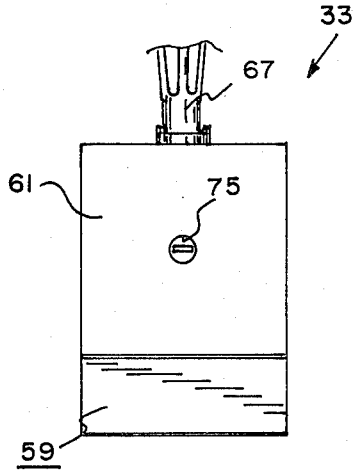
FIG. 5 is a top plan view of the structure shown in FIG. 4 with the view being taken substantially along the line V—V of FIG. 4.

From FIGS. 4 through 7 of the drawings it may readily be seen that the solitary upper-offset bracket/-wall attachment means 33 includes a primary member, as at 59, established in part by the peculiar-shaped self-engageable channellike means 39*b*, and a first stand-off element, as at 61, intergrally joined therewith as best shown in FIG. 7. The solitary upper-offset bracket/wall attachment means 33 also includes a secondary member, as at 63, for typical attachment to the wall 15 which is being shielded by the sub-assembly 19. In other words, the secondary member 63 preferably is provided with an aperture as at 65 for receiving typical screw fastener means as at 67.

The secondary member 63 includes a wall bearer element, as at 69, which is integrally joined with a perpendicularly disposed second stand-off element, as at 71, which is continguously engageable with the first stand-off element 61. Moreover, the first and second stand-off elements 61, 71 respectively are provided with alignable apertures, as at 73, for ultimately receiving screw joining means, as at 75. In this manner the primary and secondary members 59, 63 are fixedly joined one with the other—subsequently to the secondary member 63 having previously been affixed to the wall 15 in the typical fashion.

Here again, the perculiar-shaped self-engageable channellike means 39*b* (FIGS. 6, 7) includes an elongated protuberant member, as at 77, which is substantially identical to the previously mentioned protuberant members 47, 53 and function in like manner, i.e., the protuberant member 77 interlockably engages the ridge means 27 in such a manner that the sub-assembly 19 remains absolutely unaltered by the implementation of the solitary upper-offset bracket/wall attachment means 33.

The significance of the two-piece construction for the solitary upper-offset bracket/wall attachment means 33 is to facilitate attaching the sub-assembly 19 to the wall 15. In other words, without the two-piece construction, it would be rather awkward in accomplishing an optimum installation. Therefore, the primary member 59 may first be joined with the sub-assembly 19, and the secondary member 63 may then be suitably attached to the wall 15 prior to installing the screw joint means 75. The installation of the screw joint means 75 preferably is the final step in accomplishing the attachment.

It is significant to note that the solitary upper/offset bracket/wall attachment means 33 is the only physical attachment to the wall, i.e., no other screw structure or the like is required for adherence to the concept of the present invention. In addition, it should be noted that the concept of the support means 25, as herein disclosed, does not depend upon altering the sub-assembly 19 in any fashion. Therefore, the sub-assembly 19 may interchangeably be used in either of the two dispositions depicted in FIG. 1, i.e., the sub-assembly 19 which is shown attached to the wall, in the manner above described, may subsequently be adapted for use on the floor 17, thus constituting the sub-assembly which will be distinguishable by a prime suffix, thus 19', and which has the leg support means 31 and the attachment means 33 removed therefrom.

Although the invention has been described and illustrated with respect to a preferred embodiment thereof, it should be understood that it is not intended to be so limited since changes and modifications may be made therein which are within the full intended scope of the invention.

I claim:

1. Thermoshield means intended for use in conjunction with a space heating appliance, said thermoshield means comprising a sub-assembly including a planar sheet of heat insulating material for providing an optimum heat barrier and a panel member formed from durable sheetmetal for providing support and a covering for at least one side of said sheet of heat insulating material and thusly establishing a durable obverse side for said sub-assembly, the marginal edges of said panel member being foldably doubled about the entire perimeter of said sheet of heat insulating material, thus encasing the obverse side and the marginal edges thereof, said panel member being fixedly crimped in place about the perimeter of the reverse side of said sub-assembly, support means for supporting said sub-assembly in an optimum up-right disposition between the space heating appliance and a wall situated adjacent thereto thus said sub-assembly provides a heat shield for the wall, continuous ridge means defining the circumjacency of said obverse side of said sub-assembly for providing an enhancement in the effectiveness of said support means; said support means including at least: (1) leg support means for engaging and thus supporting the lowermost portion of said sub-assembly a spaced distance above a floor surface thus allowing for free passage of air beneath said thermoshield means, and (2) solitary upper-offset bracket/wall attachment means for: (a) establishing and maintaining an optimum spaced distance between the uppermost portion of said sub-assembly and the wall which is being shielded therewith, and (b) providing a solitary means for attaching said sub-assembly to the wall; said leg support means includes leg attachable/detachable means for removably joining said leg support means to said sub-assembly, and said solitary upper-offset bracket/wall attachment means including solitary bracket attachable/detachable means for removably joining said solitary upper-offset bracket/wall attachment means to said sub-assembly, said leg attachable/detachable means as well as said solitary bracket attachable/detachable means are similiary characterized by peculiar-shaped self-engagable channellike means for interlockable engagement with said ridge means.

2. Thermoshield means intended for use in conjunction with a space heating appliance, said thermoshield means comprising a sub-assembly including a planar sheet of heat insulating material and a panel formed from durable sheetmetal for covering at least one side of said sheet of heat insulating material and thusly establishing a durable obverse side for said sub-assembly, support means for engaging and thusly supporting said sub-assembly in an optimum up-right disposition between the space heating appliance and a wall situated adjacent thereto, whereby said sub-assembly provides a heat shield for the wall; and continuous ridge means defining the circumjacency of said obverse side of said sub-assembly for providing an enhancement in the effectiveness of said support means, said support means including a plurality of peculiar-shaped self-engageable channellike means for interlockable engagement with said ridge means, said support means including at least: (1) leg support thus allowing for free passage of air beneath said thermoshield means, and (2) solitary upper-offset bracket/wall attachment means for: (a) establishing and maintaining an optimum spaced distance between the uppermost portion of said sub-assembly and the wall which is being shielded therewith, and (b) providing a solitary means for attaching said sub-assembly to the wall; said leg support means including leg attachable/detachable means for removably joining said leg support means to said sub-assembly and said solitary offset bracket/wall attachment means including solitary bracket attachable/detachable means for removably joining said solitary offset bracket/wall attachment means to said sub-assembly wherewith said leg attachable/detachable means are similarly characterized by each having one of said plurality of said peculiar-shaped self-engageable channellike means attached thereto.

3. The thermoshield means as set forth in claims 1 or 2 in which said support means additionally includes a pair of lower-offset bracket means for establishing and maintaining an optimum spaced distance between the lowermost portion of said sub-assembly and the wall which is being shielded therewith, each of said lower-offset bracket means includes spacer attachable/detachable means for removably joining said lower-offset bracket means to said sub-assembly wherewith said spacer attachable/detachable means is further characterized by having a portion of said plurality of peculiar-shaped self-engageable channellike means attached thereto.

4. The thermoshield means as set forth in claim 3 in which each of said lower-offset bracket means includes a wall engaging member intended to restingly engage the wall, and a stand-off member interposed between said wall engaging member and said peculiar-shaped self-engageable channellike means for providing the optimum spaced distance between the lowermost portion of said sub-assembly and the wall, thus the offset arrangement provides for optimum air flow behind said sub-assembly.

5. The thermoshield means as set forth in claims 1 or 2 in which said solitary upper-offset bracket/wall attachment means includes a primary member established in part by one of said peculiar-shaped self-engageable channellike means and having a first stand-off element integrally joined therewith, and a secondary member for typical attachment to the wall which is being shielded by said sub-assembly; said secondary member includes a wall bearer element integrally joined with a perpendicularly disposed second stand-off element which is contiguously engageable with said first stand-off element, said first and second stand-off elements respectively being provided with alignable apertures for ultimately receiving screw joining means for fixedly joining said primary and secondary members one with the other subsequently to said secondary member being affixed to the wall.

* * * * *